United States Patent [19]

Boyd

[11] 4,010,594

[45] Mar. 8, 1977

[54] METHOD FOR SUPPLYING BOXES TO A PLURALITY OF FILLING AND WEIGHING STATIONS AND REMOVAL OF FILLED BOXES THEREOF

[75] Inventor: Jerry Lyndell Boyd, Bakersfield, Calif.

[73] Assignee: Stanley A. McClusky, Bakersfield, Calif.

[22] Filed: May 3, 1976

[21] Appl. No.: 682,561

Related U.S. Application Data

[62] Division of Ser. No. 580,767, May 27, 1975.

[52] U.S. Cl. ..... 53/35

[51] Int. Cl.[2] ..... B65B 1/32

[58] Field of Search ..... 53/35, 59 W, 64, 67, 53/69, 250, 251, 237, 240, 55; 177/53, 52; 198/21; 141/83, 153, 157, 170

[56] References Cited

UNITED STATES PATENTS

| | | | |
|---|---|---|---|
| 1,140,915 | 5/1915 | Redd | 177/52 |
| 3,225,847 | 12/1965 | Vergobbi et al. | 177/52 |

*Primary Examiner*—Travis S. McGehee
*Attorney, Agent, or Firm*—Poms, Smith, Lande & Glenny

[57] ABSTRACT

A method for supplying empty boxes to a plurality of filling and weighing stations for filling boxes at said stations each independently of other filling stations, and removal of filled boxes from said filling and weighing stations along a common discharge path without box interference. The filling and weighing stations are arranged in a line. Parallel to this line for at least the length of the filling station line is an empty box feed conveyor. Empty boxes are moved along said box feed conveyor so that an empty box is in ready position opposite a filling and weighing station for immediate replacement of a filled box, the empty box being utilized to displace the filled box from the filling and weighing station and to move the filled box onto a discharge conveyor arranged along a line parallel to said filling and weighing station line and on the side opposite from the box feed conveyor. Each filling and weighing station independently fills and weighs a box with flowable material including discrete articles, and each station determines when the filled box is ready for displacement onto the discharge box conveyor. Control means is provided along the discharge box conveyor to permit filled boxes on the discharge conveyor to be moved therealong to a discharge point without interference from boxes being displaced from filling and weighing stations. A method of supplying an empty box to each filling and weighing station in accordance with the demand for an empty box at said station.

11 Claims, 9 Drawing Figures

10
11
12
14
15
16
18
19
20
22
24
27
29
40
41
42
42t
44
49
49a
49b
49c
54
60
61
70
74
75
76
78
80
-A-
-B-
-C-
-D-
II
III 11
14
15
18
19
20
22
23
26
35
40
41
42
42t
43
49
60
61
63
-A-
-B-
-C-
-D-

12
14
42t
44
52

METHOD FOR SUPPLYING BOXES TO A PLURALITY OF FILLING AND WEIGHING STATIONS AND REMOVAL OF FILLED BOXES THEREOF

This is a division, of application Ser. No. 580,767, filed May 27, 1975.

BACKGROUND OF INVENTION

Prior proposed filling and weighing stations for boxing or packaging flowable material and various types of produce such as potatoes have been constructed and arranged to act as independent box filling and weighing units each with its own separate box in-feed conveyor means and its own box discharge conveyor means. A plurality of such independently operable box filling and weighing units may be installed in a plant and may be fed from either common or independent material feed conveyors.

In some prior proposed box filling and weighing constructions, a plurality of boxes were treated as a group. In other words, a group of six boxes were fed along a path, the group of six boxes simultaneously laterally transferred to a filling zone, and when all of the six boxes of the group were filled and weighed the six filled boxes were moved as a group from the filling zone and conveyed as a group to a discharge or distribution area. Some of the prior patents disclosing machines for handling a plurality of boxes as a group are U.S. Letters Pat. Nos. 607,472, 1,140,915, 2,100,874, and 2,333,790. Since groups of boxes were treated as units, break down of one of the filling machines would delay the movement of the other five boxes even though they may be filled and the filling machine may be in operable order to receive successive boxes for filling. In addition, handling six boxes as a group unit required that six individual or discrete pieces of apparatus must be employed and coordinated so that the six boxes could be moved and displaced as a unit. To achieve such unitary movement of a group of six discrete boxes, careful timing and coordination was required so that simultaneous actuation could be achieved.

Where the desirable projected rate of filling and weighing boxes with a flowable produce requires a plurality of filling and weighing stations, it is desirable that the plant area devoted to such filling and weighing operations occupy and utilize only that plant area required for such a filling and weighing operation and that maximum efficiency and effectiveness be provided in the utilization of such plant area. In the prior proposed filling and weighing machines mentioned above, the use of a plurality of individual machines with a plurality of individual box in-feed conveyors and a plurality of individual box discharge conveyors occupied more plant space than necessary for an efficient, effective filling and weighing operation. The treatment of a plurality of boxes at the unit served to reduce the maximum plant space area to some extent. A more efficient and effective utilization of plant space area for a box filling and weighing operation is proposed by the apparatus and method of this invention as will be described hereafter.

SUMMARY OF INVENTION

The present invention contemplates a method for filling and weighing boxes with a flowable material in which the requirements for space for the machine are most effectively met and in which the plant space required for filling and weighing operations is substantially less than the space required by prior proposed filling and weighing machines capable of comparable output. The present invention contemplates, generally speaking, that a plurality of filling and weighing machines be arranged in a tandem line, each machine oriented in the same manner, and that a single box feed conveyor means be employed to feed all of the filling and weighing stations, and also that a single box discharge conveyor be employed to remove filled boxes from the machine. Duplication of box in-feed and discharge conveyors is avoided. The invention contemplates that the box feed conveyor is controlled and arranged so that, as the filling and weighing machines are independently operable, an empty box will be available in ready position for each of the filling and weighing stations regardless of the rate of filling or speed of operation of any of the other filling and weighing stations.

The primary object of the present invention therefore is to disclose a novel method for filling and weighing boxes in which effective use of plant space is made and in which each of a plurality of box filling and weighing stations are operable independently of each of the other stations. Empty boxes are supplied to the line of filling stations, by a single box feed conveyor means having means for stopping and holding an empty box in a ready position opposite each filling station and actuable to be pushed transversely against a filled box at said station to displace the filled box onto a discharge conveyor means while the empty box assumes the filled position at the filling and weighing station. Boxes displaced from the filling and weighing station are moved onto a single discharge conveyor means for transport to a discharge or distribution area. In a preferred embodiment of this invention the line of plurality of filling and weighing stations lies between and parallel to the spaced parallel box feed and discharge conveyor means.

The primary object of the present invention therefore is to disclose a novel method for furnishing empty boxes along a single path to a plurality of filling and weighing stations and to remove boxes from said stations onto a single discharge box conveyor means.

An object of the present invention is to disclose a box feed conveyor means in which the movement of the boxes along a path parallel to the line of filling and weighing stations is controlled so that an empty box is available opposite each station for immediate replacement of a filled box at said station.

Another object of the present invention is to disclose an empty box feed conveyor means in which empty boxes in ready position opposite a box filling and weighing station are transversely displaced against a filled box to push the filled box onto a discharge conveyor means and to reposition the empty box in filling position at said station.

Another object of the invention is to disclose a box control system for regulating the discharge of filled boxes from filling and weighing stations onto the discharge conveyor means so that once a box is on the discharge conveyor means, its travel along the discharge conveyor path will not be interferred with by other filled boxes.

This invention contemplates the arrangement of a plurality of filling and weighing stations in a line in more than one pattern, one such pattern including modular spacing of such filling and weighing stations in accordance with a box dimension, length or width, and another pattern including the spacing of such stations at less or more than a box dimension. Control means for the boxes in different of such patterns may vary, this invention contemplating an exemplary control means for the patterns mentioned above.

A still further object of the present invention is to disclose a method of supplying empty boxes along a common path to a plurality of filling and weighing stations and to feed an empty box to each station as that station requires an empty box.

Various other objects and advantages of the present invention will be readily apparent from the following description of the drawings in which exemplary embodiments of this invention are shown,

Figure 1:
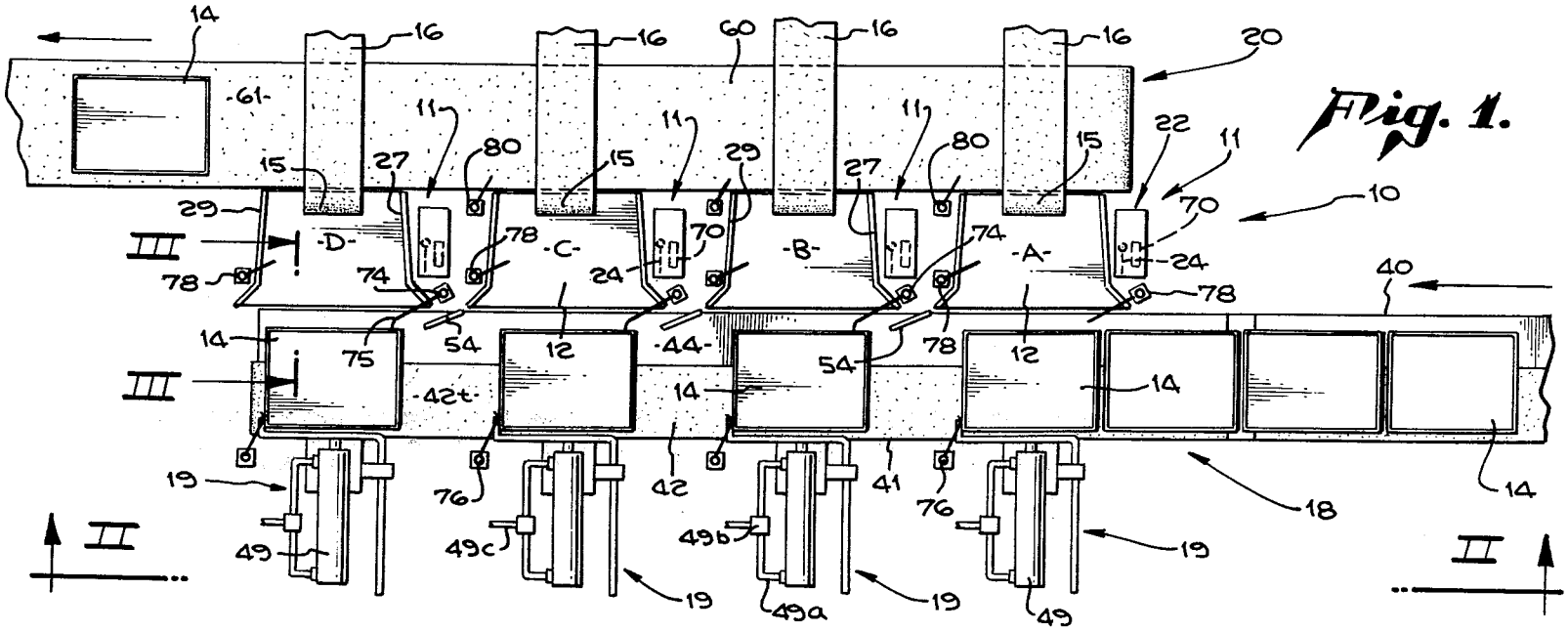
FIG. 1 is a top schematic plan view of a box filling and weighing machine embodying one embodiment of this invention, the filling stations being spaced apart a distance other than a module of a box dimension.

A filling and weighing machine embodying this invention is generally indicated at 10, FIG. 1. In general, machine 10 includes a plurality of filling and weighing stations 11 arranged in a line, each station 11 having a weighing platform 12 for supporting a box 14 to be filled. Above each weighing platform is positioned a discharge end 15 of a fill conveyor 16 arranged to transport discrete articles or flowable material to an empty box positioned on weighing platform 12. Fill conveyors 16 may be supplied with produce such as potatoes from a sizing machine so that each filling and weighing station 11 may provide boxes filled with produce of selected size. It will be understood that fill conveyors 16 may be used to transport various categories and sizes of articles and material to the weighing station as desired.

Empty boxes 14 are supplied to the weighing stations 11 by an empty box feed conveyor means generally indicated at 18 which is provided with means generally indicated at 19 for stopping a box 14 opposite weighing station 11 and holding the empty box in a ready position. Means 19 is actuatable to transfer as by pushing an empty box from ready position onto weighing platform 12 of the weighing station 11 when a box has been filled to a selected weight on platform 12 and is ready for discharge onto discharge conveyor means generally indicated at 20. An empty box 14 thus pushes a filled box off platform 12 onto discharge conveyor means 20 where the filled box will be transported to selected distribution or storage. Control means in the form of electrical switches and circuitry are provided for controlling the movement of empty boxes 14 along the length of the empty box feed conveyor means, onto the filling and weighing station 11, and from the filling and weighing station 11 onto and along the discharge conveyor means 20. The control means provides for independent separate weighing and filling at each station 11, for providing an empty box in ready position as demanded by each of the filling and weighing stations, and for transport of filled boxes along the discharge conveyor means without interference from filled boxes at other weighing stations which may be ready for discharge onto the discharge conveyor means. In this embodiment, machine 10 has stations A, B, C, and D spaced apart a distance other than a box dimension, which is taken in the direction of the empty box feed.

Figure 2:
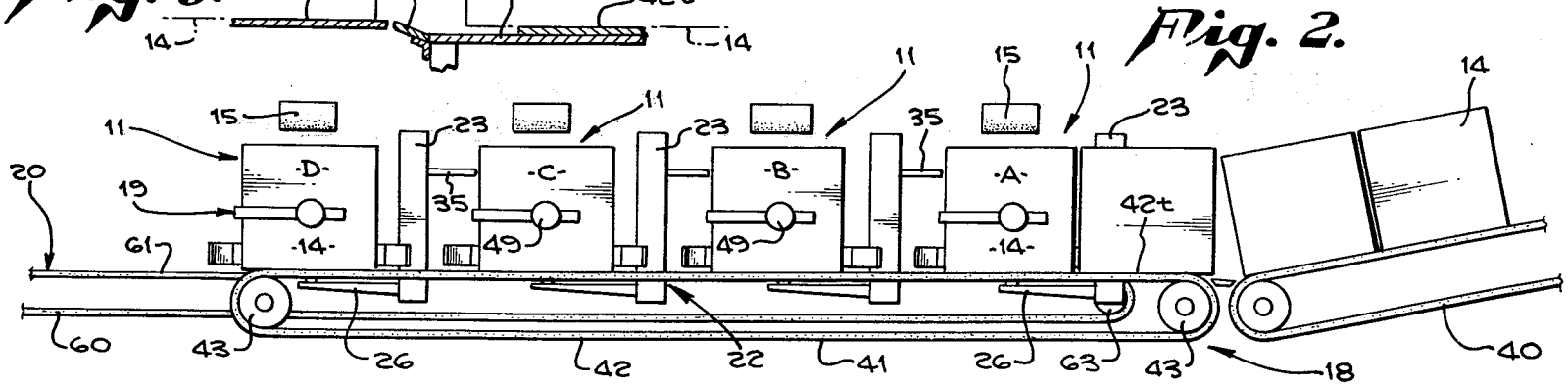
FIG. 2 is a side schematic elevational view of the machine shown in FIG. 1, the view being taken in the plane indicated by line II—II of FIG. 1.
Figure 3:
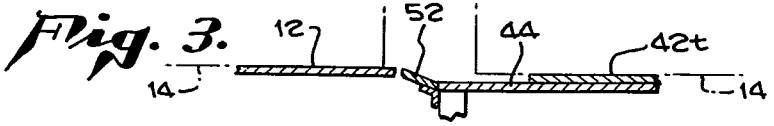
FIG. 3 is a fragmentary sectional view taken in the plane indicated by line III—III of FIG. 1.

In detail, each filling and weighing station 11 includes weighing platform 12 which may be part of a standard well known weighing scale means 22 which may include an upstanding housing 23 which encloses an indicator 24 viewable through a side window provided in the housing 23. The scale means 22 may be of well known manufacture such as a Fairbanks scale, equipped with a SPINX-O-MATIC weight indicator made by Spinx Mfg. Co. Such a scale means includes well known means for adjusting the weight indicator 24 to read a preselected weight such as 50 and 100 pounds. In FIG. 2 scale means 22 is schematically indicated and at the bottom of housing 23 a weigh arm 26 may extend away therefrom for supporting the weighing platform 12.

Figure 4:
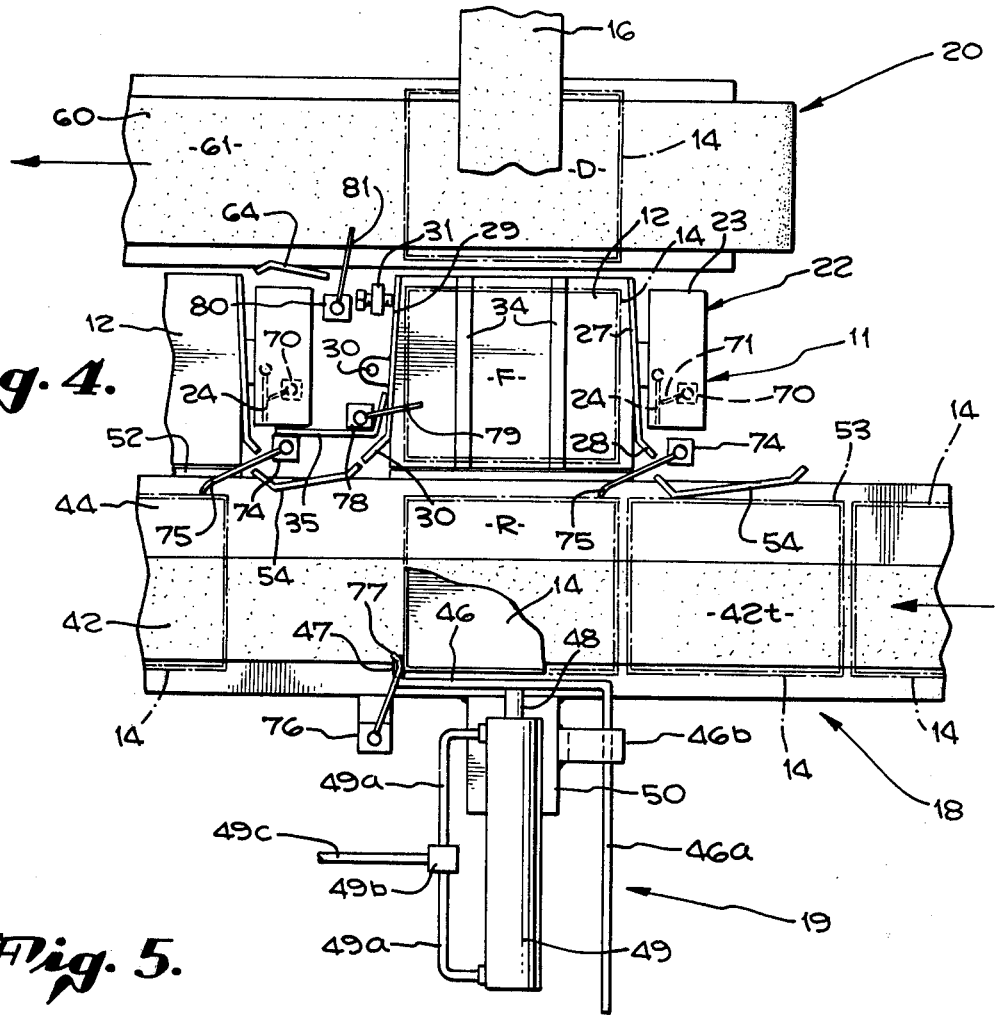
FIG. 4 is an enlarged fragmentary view of the first two box filling and weighing stations shown in FIG. 1.

As best shown in FIG. 4, weighing platform 12 is rectangular and slightly larger than the rectangular area of a box 14 to be filled on the platform 12. With respect to the direction of feeding of empty boxes as indicated by the arrow on the feed conveyor means 18, the near transverse edge of platform 12 is provided with an upstanding wall 27 having an out-turned bent end portion 28 to facilitate guiding an empty box onto the platform 12. Similarly, on the far edge of platform 12 a wall 29 is also provided with an outwardly turned end portion 30 to facilitate guiding an empty box onto platform 12. Adjacent the discharge conveyor means 20, walls 27 and 29 may slightly converge to impart a selected squeeze force on a filled box so that the filled box will not be ejected onto the discharge conveyor means with too much speed and force as later described. Wall 29 may be pivoted at 30 and an adjustment bolt means 31 may provide for desired bending or flexing of wall 29 to adjust the width of the opening between walls 27 and 29 through which the box passes to the discharge conveyor means.

Movement of a box onto and off platform 12 may be facilitated by a pair of spaced parallel straps 34 fixed to the platform 12 so that the entire flat bottom surface area of the bottom wall of the box 14 is not in full contact with the area of platform 12. Housing 23 of the next adjacent scale means 11 may be provided with a rearwardly extending guide bar 35 fixed to the housing at a height so selected that the bar when disposed horizontal will support in upright position a flap of the top wall of a box positioned on the scale platform 12. Such a guide bar is not required at the opposite transverse edge of the platform 12 or above wall 27 because of the proximity of the wall of housing 23 thereabove.

Empty box feed conveyor means 18 is supported alongside the line of weighing stations 11 by any suitable well known framework structure (not shown), adjustable to a selected height for correlation with other equipment. Box feed conveyor means 18 may include a first conveyor section 40 and a second conveyor section 41. The first conveyor section 40 provides means for feeding empty boxes which have been expanded to open box form with a closed bottom wall, peripheral side walls and flaps forming the top wall in upstanding position to provide an opening into which discrete articles for flowable material may flow. In this example, the first box feed conveyor section 40 is illustrated as inclined so that as the empty boxes are so prepared and formed, they may be placed upon the conveyor section 40 and fed by gravity in abutting contact to the second feed conveyor section 41. It is understood that the first feed conveyor section 40 may be arranged in line with the second feed conveyor section 41 or may approach the feed end of conveyor section 41 at any selected angle depending upon plant space requirements.

The second empty box feed conveyor section 41 may include a continuously moving endless belt 42 supported at ends by end rollers 43. The top lay 42*t* may be supported between end rollers 43 by suitable horizontal plates 44 extending between side frame members of the conveyor supporting frame structure. The width of belt 42 is less than the width of plates 44 and of a box to be carried on the conveyor means 18. Since belt 42 is continuously moving, the reduced width of the belt will have less effect on a box when the box is moved transversely of the belt onto a platform 12. Further, advancement of empty boxes to ready positions *R* will be facilitated, such boxes being laterally, outwardly deflected as later described. An empty box carried by top lay 42*t* of reduced width of the continuously moving endless belt 42 will be readily supported and advanced along the line of weighing stations 11 to a ready position *R* opposite a weighing station as needed by the weighing station by control means as later described.

The continuously moving endless belt 42 may be driven at a constant preselected speed by suitable motor and gear means, not shown. It will be understood that while a gravity feed has been described for first conveyor section 40, that if desired, suitable drive means may be provided for conveyor section 40 so that a line of empty boxes is provided for instant feeding onto the second conveyor section 41.

Means 19 for moving an empty box from ready position *R* opposite a filling station 11 onto the weighing platform 12 may comprise a horizontally disposed push bar 46 located above the horizontal plane of the top lay 42*t* of the endless belt 42, said bar 46 having an inboardly directed short stop lug 47 on its end to prevent the advancement of a box by the top lay 42*t* when the leading wall of the outboard corner of the box engages stop lug 47. Push bar 46 is carried by the end of a piston rod 48 of a double acting cylinder and piston means 49 actuated by fluid such as pressure air. Push bar 46, FIG. 4, is about the length of a box. At the tracking end of bar 46 is formed an outboardly directed bar extension 46*a* having a length approximately the stroke length of piston rod 48. Extension 46*a* is slidable in a support member 46*b* fixed on bracket 50 and serves to hold bar 46 in horizontal position and to slide along the leading wall of the next box when moving a box onto the platform 12. Gouging, marring, or lateral displacement of the leading walls of the next box is avoided during reciprocal movement of bar 46.

The double acting cylinder means 49 has pressure air hoses 49*a* connected at opposite ends of the cylinder. Hoses 49*a* are connected to an Aro Corp. four-way air valve 49*b* of spool type, solenoid operated, the valve being of known manufacture. The valve 49*b* is connected to a suitable compressed air source, not shown, by inlet hose 49*c*.

Cylinder and piston means 49 is suitably mounted on bracket 50 carried on the frame structure of the empty box feed conveyor means 18. The axis of piston rod 48 is about in alignment with the center portion of the weighing platform 12. Piston rod 48 is actuated in a short stroke and long stroke mode, the short stroke being used to clear an empty box with respect to the stop lug 47 for further advancement by the moving belt lay 42*a* as later described, and the long stroke being used to engage and push an empty box entirely across the belt lay 42*t* into filling position on the weighing platform 12. When the long stroke of piston cylinder means 49 occurs, as called for the weighing station, an empty box at *R* position will abut and push a filled box from weighing platform 12 onto the discharge conveyor means 20.

When the short stroke of the cylinder and piston means 49 occurs as called for by an empty or vacated *R* position opposite a weighing station, such short stroke of the piston rod 48 and the transverse movement of push bar 46 moves the empty box towards the opposite inboard edge of conveyor means 18. In such short stroke operation of push bar 46, the box loses contact with switch 76, later described, causing retraction of the push bar. Further transverse movement of empty box 14 is restrained by an upwardly sloping apron plate 52 carried along the inboard edge of conveyor means 18. Sufficient clearance is thus provided for the box to pass by stop shoulder 47 of the push bar. The continuously moving top lay 42*t* then advances the box beyond the stop shoulder 47 for filling an empty box space *R* farther downstream of belt lay 42*t* of conveyor means 18.

As the empty box is carried in such lateral off-set position on the lay 42*t*, inboard side wall 53 of the box will slide against an outboardly directed inclined surface of a deflector 54 carried by the next adjacent weighing station 11. Movement of the box against deflector 54 will cause it to travel transversely toward the outboard edge of the conveyor means 18 so that as it is advanced to the next box ready position *R* the outboard leading corner of the box will contact stop shoulder 47 of the box engagement means 19 at the next filling and weighing station 11.

The reduced width of belt lay 42*t* which permits the inboard edge of a box to contact stationary conveyor plate 44 tends to restrain turning of a box about stop 47 as the box is pushed toward platform 12. The box holds its orientation with the conveyor and upon contacting stop 47, is in proper *R* position.

Discharge conveyor means 20 comprises an endless belt means 60 having a continuously moving top lay 61 shown in this example as traveling in the same direction as the top lay 42*t* of the empty box conveyor means 18. Discharge conveyor means 20 lies parallel to the line of filling and weighing stations 11 and to the empty box conveyor means 18. The endless belt 60 may be suitably supported by end rollers 63, only one of which is shown in FIG. 2, one of such end rollers including a drive means for the continuously moving conveyor belt 60 so that filled boxes may be transported therealong at a selected rate of movement to a suitable discharge or storage area, not shown. Top lay 61 of discharge endless belt 60 may be supported along its length by suitable horizontally disposed plates, not shown, for supporting the weight of the filled boxes. Since the endless belt 60 is continuously moving when a filled box is pushed onto the top lay 61 by an empty box moved from ready position by push bar 46, the filled box will commence to advance along the discharge conveyor belt and will be urged laterally of the top lay 61 by suitable deflector members 54 mounted on the next adjacent filling and weighing station 11. After the filled boxes are moved beyond the filling and weighing stations the direction of travel may vary to a selected destination area.

Before describing the control means for the filling and weighing operation performed by the above-described machine, it should be noted that empty boxes 14 are held in ready positions *R* by stop lugs 47 on push bars 46 located along the outboard side of the empty box feed conveyor means 18. When an empty box is on filling and weighing platform 12, the box is in a fill position *F*. When a box is filled and moved out of the fill position *F* onto the discharge conveyor means 20 it will first assume a position indicated by *D* at which it is engaged by the top lay 61 of the continuously moving discharge endless belt 60.

Figure 7:
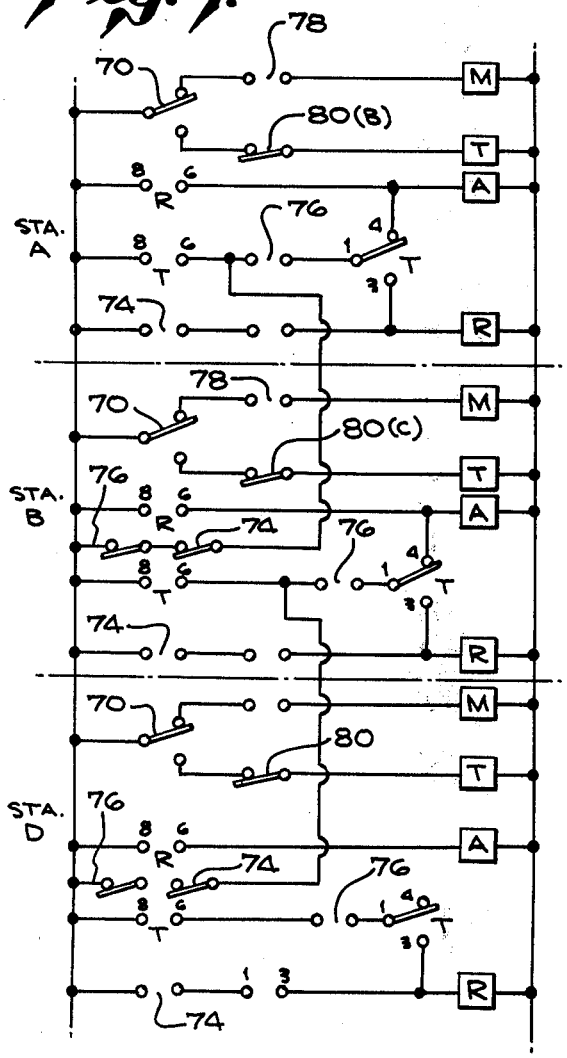
FIG. 7 is a schematic circuit diagram for the machine shown in the embodiment of FIG. 1 – 4 inclusive.

Control means for the stations A, B, C and D of box filling and weighing machine 10 include the following switch means which are located as shown in FIG. 4 and electrically interconnected as shown in FIG. 7.

Each filling and weighing machine 11 includes a switch 70 within housing 23 of scale means 22 and has a switch arm 71 responsive to the weight of a box being filled as indicated by the scale indicator needle 24.

Switch 74 at the inboard side of conveyor means 18 has its switch arm 75 contacted by an empty box advancing towards ready position *R*. Arm 75 holds such contact in box *R* position, is bent, and then released by a box moving into box *F* position on the scale platform, and is then again engaged by the next box advancing to *R* position.

Switch 76 at box stop 47 has its switch arm 77 contacted by the leading outboard corner portion of an empty box 14 as it moves against box stop 47. Switches 74 and 76 form part of a box advancement interlock system to assure that boxes continue to advance downstream until each box *R* position is filled.

Switch 78 at one side of platform 12 has its switch arm 79 contacted by an empty box moving onto the scale platform 12 into filling position.

Switch 80 at the inboard side of discharge conveyor means 20 and downstream from each platform 12 has its switch arm 81 extending into the path of a filled box on the discharge conveyor means 20. Switch 80 is operative to prevent a filled box being discharged onto the discharge conveyor from the next from downstream filling and weighing station 11 as described hereafter.

The path of movement of boxes in sequentially arranged stations A, B, C and D of the weighing and filling machine 10 is best shown in FIGS. 1 and 4. This movement path of the boxes is exemplary for filling stations which are spaced apart a distance less than a modular dimension of the box, that is, spaced apart a distance less than or more than the length or width of the box.

In the initial start-up of machine 10, empty boxes 14 on conveyor section 40 are fed by suitable means to the beginning of conveyor section 41. A first box advancing onto continuously moving belt lay **42*t* is moved by belt lay 42*t* to stop lug 47 opposite the first station A. In such movement, the first box contacts normally open switch 74, FIG. 7, and closes the switch 74. Relay terminals 1, 3 are closed and the relay is energized. As the box advances beyond switch 74, it contacts stop 47 and the switch arm 77 of normally open switch 76 and closes switch 76. As best seen in FIG. 7, closure of switch 76 at station A furnishes power to the timer because at station B corresponding switches 76 and 74 are in normally closed position. The relay and the timer are thus energized so that the four-way valve 49*b* connected to the cylinder and piston means 49 is actuated to cause the push bar 46 to push the empty box toward filling station A. During such lateral movement of the empty box 14, switch means 74 remains in contact with the box and remains closed. However, switch arm 77 of switch means 76 loses contact with box 14 as it passes beyond the inboard edge of box stop 47 and switch 76 of station A goes to open position. When switch 76 moves to open position it breaks the circuit to the timer contacts 1 – 4 to the air valve 49*b* so that the double acting piston and cylinder means 49 is caused to retract push bar 46 with the result that a short stroke or push is given to box 14 in ready position at station A and such short push is sufficient to clear box 14 from the box stop 47 at station A. The continuously moving belt lay 42*t* moves the box past box stop 47, the box is deflected outboardly by deflector 54 and contacts switch 74 at station B and then contacts switch 76 at station B as the box is engaged by box stop 47 of station B. When the box at station A was advanced to station B, the inboard side of box 14 lost contact with switch 74 and switch 74** of station A returned to open position.

The next box entering the ready position of station A is in back to back relation with the first box and is restrained from filling station A box ready position by the outboard extension **46*a* of the push bar, the extension 46*a* sliding partially along the leading wall of the next box and then upon retraction also sliding along the portion of the leading wall of the next box until it disengages the box at the outboard edge of the conveyor 41. The next box is advanced by the continuously moving belt lay 42*t* and contacts switch arm 75 of switch 74 at station A and closes normally open switch 74**. The sequence of steps described with the first box in station A is repeated with the second box entering station A and will not be again described for brevity.

The first box which has advanced to station B will be advanced to station C in a manner similar to that described for station A. As seen in FIG. 7, closure of switch 74 energizes the relay. When the box contacts switch 76, 76 will close and complete a circuit to the timer which includes the interlock circuit of normally closed switches 76, 74 of the next station along the line of stations. Closure of 76 at station B also causes opening of the normally closed set of contacts of switch 76 at station B to thereby open the interlock circuit to station A and prevent a box from advancing into station B until station B is ready to receive the box. If the next station in line does not have a box in ready position, then the closure of switch 76 completes the circuit through timer contacts 1 – 4 and causes the four-way air valve to actuate the push bar 46 of station B through a short stroke sequence as above described with station A to permit the box to advance to the next station C.

At the last station in line, in this example, station D, the box is advanced to ready position in the same manner as before. Since station D is the last station in line, a short piston stroke is not required. As seen in FIG. 7 the presence of a box in ready position *R* at station D closes normally open switch means 74 and 76 but until the timer is energized the air valve 49*b* will not be actuated to cause the push bar 46 to push an empty box away from its ready position.

In the initial start-up of machine 10, assuming that a box is in ready position at one or more stations along the line of stations A, B, C and D, it becomes necessary to manually satisfy the weight condition on the scale in order to move a box onto the scale platform 12. Referring to station A as well as stations B, C, and D, satisfying the preset scale weight closes a normally open set of contacts of switch 70 to provide a circuit through the normally closed switch 80 to the timer. Closing of the circuit to the timer energizes the solenoid air valve 49*b* to cause the push bar 46 to push the empty box onto the scale platform. As the empty box is pushed beyond the inboard edge of stop 47 and switch arm 77 disengages the box, the air valve will not be reversed in operation because normally closed switch 76 at the next station B is in normally open position and the interlock circuit is open. As the box advances onto the scale platform, switch arm 75 of switch 74 remains in contact with the side of the box until it is fully on the platform and then the switch arm 75 swings back to its normal position for contact with a box in ready position *R*. The next succeeding box is restrained from advancing into ready position *R* by the outboard extension 46*a* which slides fully across the leading wall of the next box. Thus for a short interval of time, switch 74 may be in open position to be closed by the next box in line after extension 46*a* has been fully retracted.

As the box moves onto the scale platform 12, the box engages switch arm 79 of switch 78. Switch 78 is normally open and is closed by the box. Since the empty box does not satisfy the scale weight, a circuit is provided through switches 70 and 78 to energize the motor for the filling conveyor 16 and the filling conveyor 16 transports material to be weighed to the scale platform and discharges the material into the box on the scale platform. This operation occurs at each of the filling stations as soon as the scale weight is satisfied.

When the box is filled to the selected weight, closed switch 70 at the scale is opened breaking the circuit to the motor driving the filling conveyor 16 and stopping the conveyor 16. Switch 70 has another set of contacts which are closed by the satisfaction of the weight in the box and completes a circuit through normally closed switch 80 to the timer. If there is a box in ready position with switches 74 and 76 closed at station A, the timer provides sufficient time for the last of the material to fall from the filling conveyor 16 into the box and then, if an empty box is in ready position with switches 75 and 76 closed, the four-way air valve 49*b* is actuated to cause the push bar 46 to commence a stroke toward the platform 12 on which is now carried a box filled with the material to be packaged. As the box moves beyond the contact of switch arm 77 of switch 76, switch 76 is opened at station A. If there is a box in ready position at station B, the interlock circuit is open because switch 76 is open and the four-way air valve continues to supply air to the piston cylinder means 49 to cause the push bar 46 to travel across conveyor 18. The empty box at ready position at station A pushes the filled box off the scale platform 12 onto the discharge conveyor belt 61. Switch 78 opens as the filled box leaves the platform and closes as soon as the empty box is in position beneath the filling conveyor 16 and the switch 70 has closed because of the lack of weight on the scale. Thus, as seen in FIG. 7, switches 70 and 78 are again in closed position to energize the motor of the filling conveyor to cause material to be weighed to flow into the box on the scale platform.

The action of the cylinder and piston means 49 in pushing the empty box and the filled box from ready and filled positions respectively may be quite rapid depending upon the air pressure supplied to the cylinder and piston means 49. Since such replacement of a filled box with an empty box is desired to be rapid, the force required to move the filled box onto the discharge conveyor may require that some restraint means be placed on the movement of the box so that it does not overshoot the discharge conveyor. For this purpose, the side walls 27 and 29 slightly converge to frictionally engage front and back walls of the box and such convergence and frictional engagement is adjusted by the adjustment nut and bolt 31.

The sequence of moving a box from ready position *R* onto the scale into filling position *F* at each of the stations is essentially the same as indicated by the circuit diagram for stations B and D. It will be apparent that as the filled box satisfies the scale weight and causes the cylinder and piston means to be actuated to replace the filled box with an empty box that this sequence occurs at each station independently of the other stations and that as soon as a box is filled to the desired weight, it is removed and replaced by an empty box.

When the filled box is on the continuously moving belt lay 61 of the discharge conveyor means, it will be transported along the discharge conveyor means 20 at a selected speed. Since a filled box at station A, B or C must pass alongside stations further downstream, traffic control means are provided by the switch 80 and its switch arm 81. Referring to FIGS. 1 and 4 again, the switch arm 81 shown in FIG. 4 is associated with the switch means 80 of station B. As a discharged box from station A contacts the switch arm 81 of station B, the normally closed switch 80 is opened and if a filled box is ready to be discharged from station B, the timing circuit for station B is opened and the box is held in position on the platform at station B until the filled box has passed and has disengaged from the switch arm 81. Upon closure of switch 80 the timer will recommence its timing delay function and a filled box will be discharged from station B when the space on the discharge conveyor 20 is not occupied by a filled box being transported thereby.

The switches 80 at each of the stations B, C, and D operate in the same manner so that a collision of boxes on the discharge conveyor is prevented.

From the foregoing description, it will be apparent that as any box ready position R is vacated by a box moving onto the filling platform, the interlock circuit is completed and calls for a box at the next upstream station to be advanced. Advancement of boxes along the empty box feed conveyor is thus automatically continually performed as the need for a box at position *R* at any station occurs. In one exemplary use of machine 10, each of the filling conveyors 16 may be associated with a produce sizing machine such as a potato sizer. Thus each of the filling conveyors 16 may be supplying potatoes of different size than an adjacent filling conveyor 16. The difference in size of potatoes and also a variance in the rate of speed of the conveyor 16 will cause a variance in the filling of boxes at the filling stations. Boxes of large sized potatoes may be filled more rapidly than boxes of smaller sized potatoes. Each weighing station is therefore independently actuated and the common empty box conveyor means 18 with the continuously moving conveyor belt 42 and the cylinder and piston means for engaging an empty box at ready position is capable of supplying the demand of empty boxes at each station even though the speed of operation of each station may vary.

The above-described embodiment of the invention is useful where boxes of different size may be supplied to the filling stations for filling and weighing different types of produce or articles of flowable material to be packaged in the boxes. The common empty box feed conveyor means 18 will require virtually no change in the location of the switches and various component parts of the machine as described above. In some instances it may be necessary to shift slightly the location of switch 74 and its switch arm 75 since switch 74 is part of the interlock system and as indicated in FIG. 7 for station B and D, must be in normally closed position in order to provide current to the station upstream to cause advancement of a box from the upstream station to its station.

Figure 5:
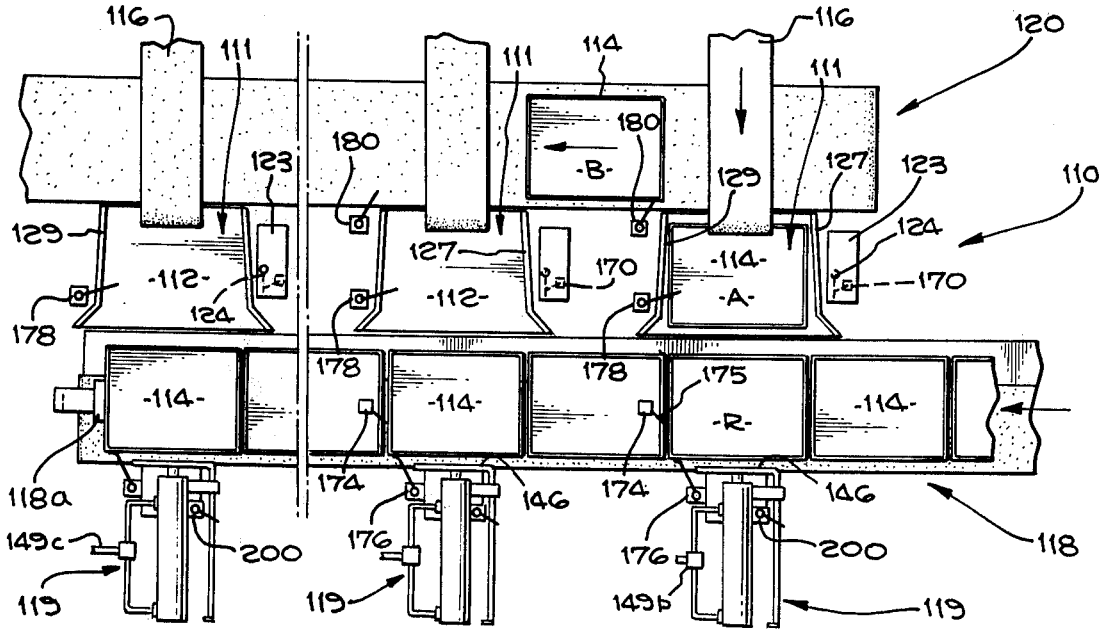
FIG. 5 is a fragmentary schematic top plan view of a different embodiment of the filling and weighing stations, the stations being modularly spaced apart a box dimension.
Figure 6:
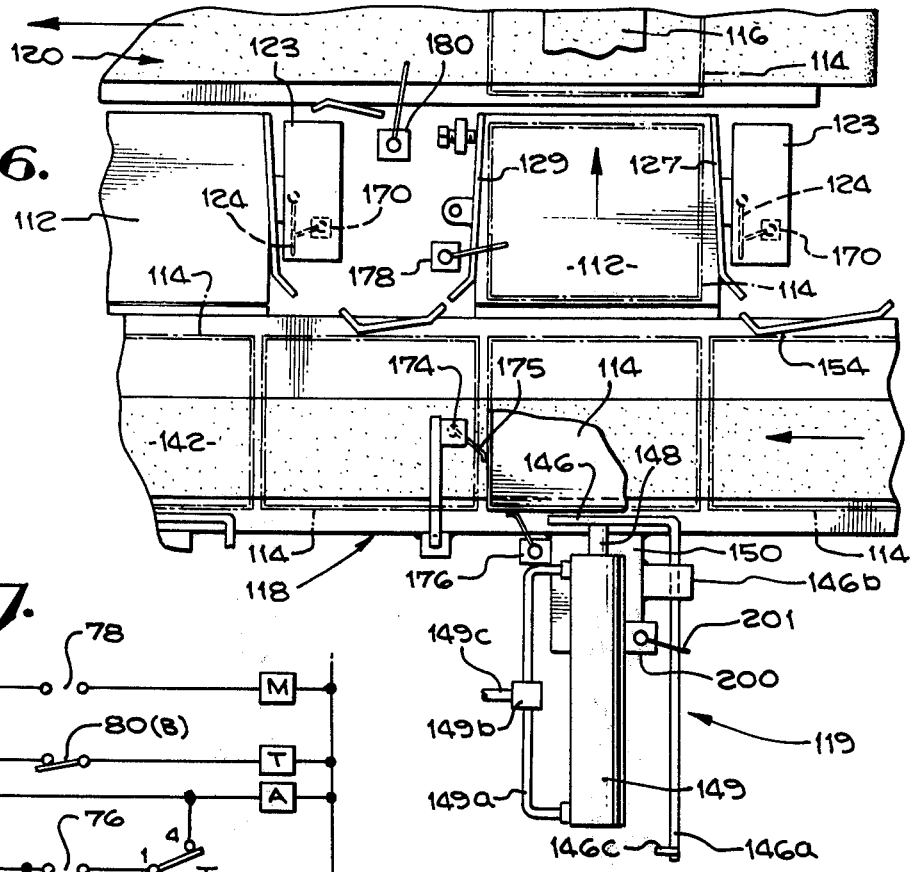
FIG. 6 is an enlarged fragmentary view of the first two stations shown in FIG. 5.

In the embodiment of the invention shown in FIGS. 5 and 6, stations are spaced apart a module of a box dimension, that is either the width or length of the box depending upon the most desirable orientation of the box in the station for feeding. In the description of FIGS. 5 and 6 like parts of the machine will be referred to with like reference numerals plus 100.

Thus, machine generally indicated at 110 comprises an empty box feed conveyor means 118 common to a plurality of filling and weighing stations 111 arranged in sequence each having a scale platform 112 from which a filled box may be pushed onto a discharge conveyor means 120. Filling conveyors 116 are associated with each station 111 for discharge of produce to be boxed. Each filling station has a scale 123 provided with a scale indicator 124. Sidewalls 127 and adjustable wall 129 may converge as in the prior embodiment.

Empty box conveyor means 118 may be of the same construction as that described above and includes a continuously moving belt 142 which has a width substantially less than the transverse dimension of a box to be fed by conveyor 118.

Means 119 for engaging and pushing a box onto scale platform 12 in this modification differs from the prior embodiment in that push bar 146 has a length less than the dimension of the box longitudinally disposed on the conveyor belt 142, does not have a box stop such as 47, and includes an outboard extension **146*a* having at its outer end a switch contacting lug 146*c*. The extension 146*a* is supported from a bracket 146*b* carried on a mounting 150 secured in suitable manner to the frame of conveyor 118.**

Piston and cylinder means 149 includes a double acting cylinder means provided with pressure air hoses **149*a* and a solenoid actuated four-way air valve 149*b* and a pressure air inlet 149*c*. Push bar 146 is carried by piston rod 148** as in the prior embodiment.

In this embodiment of the invention, empty boxes 114 are fed in front to back relation, the continuously moving belt 142 carrying the boxes to the end of the conveyor means 118 where a fixed box stop **118*a* is provided. The mounting of box stop 118*a* may be adjustable longitudinally of conveyor means 118 so that when the boxes are in abutting relation, a box 114 will be directly opposite a platform 112** and at least one box will be between the empty boxes so positioned opposite their respective filling stations. It will be understood that while only one box is shown between the filling stations, there may be some installation requirements depending upon the material being handled which may require spacing of the stations one or more boxes apart. The present embodiment of the invention contemplates such a modification of the empty box feed conveyor and filling station arrangement.

Operation of the modification of the invention shown in FIGS. 5 and 6 is best described in connection with the circuit diagram shown in FIG. 8. Switch means 174, 178 and 180 are located in the same positions as in the prior embodiment. Switch means 176 has been relocated toward the central portion of the box ready position and at the side thereof and is not related to a box stop 47. Switch means 174 which was at the inboard upstream corner of a box in ready position, has been relocated to a downstream location with respect to a box in ready position, namely, an overhead location with switch arm 175 depending downwardly to engage the leading wall of a box in *R* position or in some instances the trailing wall of the next downstream box. In addition, push bar 146 has been shortened to a length much less than the length of a box in *R* position.

A new switch 200 having a switch arm 201 is carried on the piston and cylinder means mount 150, the arm 201 being contacted by tab **146*c* on the extension 146*a* when the push bar 146 is fully extended. It should be noted that a zig-zag movement of the boxes along box feed conveyor 118 is not required because of the abutment of the boxes and the lack of box stops 47.**

In initial start-up of machine 110, boxes fed to the box feed conveyor 118 are advanced by the continuously moving belt 142 until the lead box reaches box stop **118*a*. The remainder of the boxes are maintained in wall to wall contact by reason of the continuously moving conveyor belt 142. As each box moved into position, the box first contacted normally open switch 176 and closed switch 176. When the leading wall of the box was contacted by the normally open switch 174, the switch 174 was closed and the relay was energized. In this respect, it should be noted that because of the location of the switch 174 above the line of boxes and with its switch arm 175 depending to engage the upper portion of the flap of a box, it will be apparent that when switch 174 is open, then the absence of a box at the ready position is indicated and the cylinder and piston means 149** cannot be actuated.

When switch 170 is closed by satisfaction of weight on the scale platform 112, the circuit to the timer is completed, switch 200 is closed and the solenoid operated four-way air valve **149*b* is actuated to cause the push bar 146 to push an empty box onto the scale platform. Operation of the four-way air valve is reversed when the switch tab 146*c* contacts switch arm 201 thereby opening the circuit to de-energize the relay and to thereby cause the air valve to reverse and the push bar 146** retract.

Figure 8:
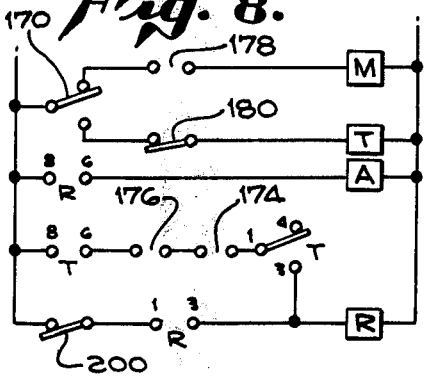
FIG. 8 is a schematic circuit diagram for the machine shown in the embodiment of FIG. 5 – 6 inclusive.

In FIG. 8 a switch 180 is shown, switch 180 being associated with the circuit for the next filling station downstream. Switch 180 operates in the same manner as the switch 80 described in the prior embodiment.

Operation of switch 178 which senses the movement of a box onto the scale platform is also similar to that of the prior embodiment and when closed by a box energizes the motor of the filling conveyor 116 for discharge of produce into the box from the conveyor 116.

At the last downstream station in an arrangement of a plurality of filling and weighing stations such as 111, switch means 174 may be omitted so that the relay at the last filling station is energized at all times.

In this embodiment of the invention, it is important to note that when the push bar and its extension are moved transversely of the box feed conveyor 118 to push a box onto the scale platform 112, the next box in line advances against the extension 146 while the pushing and retraction of the push bar 146 occurs. In some systems of operation, switch 174 may be in normally open position and switch 176 located further upstream so that switch 176 may be placed in closed position by an advancing box and the push bar 146 actuated so as to move the box onto the scale platform as rapidly as possible. Thus, the push bar 146 could commence its push stroke before the leading wall of box 114 contacted switch arm 175 of overhead switch 174.

It will be apparent that the machine 110 operates similarly to the machine 10 in that each filling and weighing station is independently operable and that the empty box feed conveyor means is common to each station and is operated to always provide a box in ready position *R* for movement onto a scale platform 12 for a filling and weighing operation.

The arrangement of a plurality of filling stations in sequence with respect to the direction of movement of a box infeed conveyor means which is common to each station and which is capable of independently feeding boxes to each station as each station demands a box may be also readily adapted to other multi-stage box filling equipment, such as shown in U.S. Letters Pat. Nos. 3,416,619 and 3,416,620.

Figure 9:
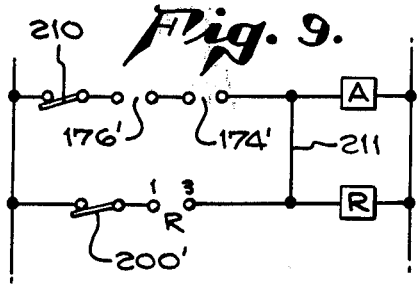
FIG. 9 is a schematic circuit diagram of another embodiment of the control means.

FIG. 9 illustrates a circuit diagram in which the switch arrangement opposite a filling station at the box in-feed conveyor means is similar to that shown in FIG. 6. An overhead box sensing switch 174' is in normally open position and adapted to be contacted by the top edge of a leading box and to be closed thereby. Switch 176' is normally open and is contacted by the side of a box moving into box ready position. Switch 200', normally closed, is a switch associated with the cylinder and piston means 149' for actuating a push bar to ram an empty box across the box in-feed conveyor means and toward the filling station. A normally closed box feed switch 210 may be located upstream the first filling station (bulk) of a two-stage box filling mechanism such as U.S. Pat. No. 3,416,619 to control advancement of a box into the first filling station.

In operation, an empty box moving into box ready position at the push bar, will close switches 176' and 174'. Box feed switch is normally closed, a circuit is completed to the air valve of the cylinder and piston means. Line 211 provides a circuit to the relay, relay points 1 – 3 are closed, switch 200' is normally closed. The ram urges the push bar and empty box toward the filling station.

When a box is pushed out of ready position by the push bar, switches 174' and 176' will open. The ram continues to push the box because of the circuit between closed switch 200', relay points 1 – 3, and line 211. The ram stroke is ended when stop tab **146*c* contacts and opens switch 200', and opening the circuit to the relay and to the air valve. The push bar is then retracted and switch 200'** returns to closed position. This sequence of operation is repeated with the next empty box.

As in the prior embodiment the empty box conveyor means has a continuously moving endless belt to advance the boxes. The system for filling the box ready position at each station may include either the short-long stroke sequence described with respect to FIG. 7 or the sequence described with respect to FIG. 8. The circuit in FIG. 9 shows control of a box at and from box ready position as demanded by a filling station.

It will be understood that the arrangement of a plurality of filling stations with the box feed conveyor means 118 and conveyor discharge means 120 occupies a minimum of plant space. The discharge conveyor means may be placed under the feed belts 116 and of course may move the boxes either in the same direction as the empty box conveyor means or in the opposite direction. A change in direction from that described merely means a change in location of switches 180. The empty box feed conveyor provides a box to each filling station independently of the other and as demanded by the filling station. Since there is always a box in ready position for movement onto the scale platform when a box is filled delay in filling time is minimized.

It will be understood that various changes and modifications may be made in the box filling machines described above and any such modifications and changes coming within the scope of the appended claims are embraced thereby.

I claim:

1. In a method of filling and weighing a plurality of boxes at a plurality of weighing scales arranged in a line, article feed means above each scale, each box being filled and discharged independently of the other boxes at said scales, an empty box feed belt, and a filled box discharge belt, the steps of:

supplying an empty box at each scale in accordance with the demand for an empty box at each scale including advancing empty boxes in a line parallel to the line of weighing scales and at one side thereof, stopping an empty box in a ready position opposite each scale, laterally moving an empty box onto a scale when the scale measures a selected weight in a peceeding box bein filled on the scale;

filling the empty box to a selected weight, moving the filled box off the scale by pushing the next empty box to be filled against said filled box until said filled box moves onto a discharge conveyor belt, and moving an empty box to each vacated ready position by successively advancing empty boxes in said line to occupy vacated ready positons wherever and whenever the vacated positions occur.

2. In a method as stated in claim 1 including the step of:

sensing presence of a box on said discharge belt;

and detaining movement of a filled box from a weighing scale at a station until the box on the discharge belt is past said weighing scale holding the detained filled box.

3. In a method as stated in claim 1 wherein the step of advancing empty boxes on said feed belt includes moving an empty box from box ready position while maintaining contact with the empty box feed belt for advancement to a vacated box ready position.

4. In a method of filling and weighing a plurality of boxes as stated in claim 1 including the step of:

sensing the presence of a box at ready position wit a switch means electrically interlocked with a switch means at the next downstream station for regulating advancement of an empty box to the next downstream station.

5. A method of feeding an empty box to a box filling station which is one of a plurality of filling stations arranged in a line, each of said filling stations being operable independently of the other stations, including the steps of:

advancing a plurality of empty boxes along a line parallel to the line of filling stations;

temporarily stopping an empty box at a ready position opposite each station;

sensing at each station the fill condition of a box at the station;

and moving one of said empty boxes from its ready position into a filling station in response to the sensing of the fill condition as full at said last mentioned filling station.

6. A method as stated in claim 5 including the steps of:

advancing in box abutting relation a plurality of empty boxes along the line of filling stations;

and stopping said plurality of abutting empty boxes with the lead box at the most distant filling station.

7. A method as stated in claim 5 including the step of:

advancing each empty box in spaced relation to the adjacent empty box along the line parallel to the filling station line.

8. A method as stated in claim 5 including the step of:

advancing a temporarly stopped empty box along the line of boxes to fill a box ready position at a filling station downstream from the position of the temporarly stopped empty box in response to the moving of an empty box into the filling station.

9. A method as stated in claim 5 wherein the step of moving the empty box into the filling station includes the step of:

pushing the empty box against the filled box in the filling station to move the filled box out of said station.

10. A method as stated in claim 5 including the step of:

laterally displacing a temporarily stopped empty box from its ready position to release said empty box for further movement downstream to a box ready position which has been vacated.

11. A method of directing an empty box to a box filling station which is one of a plurality of filling stations arranged in a line, each of said filling stations being operable independently of the other stations, whereby filling of boxes at each station may be completed at different times and each station may require an empty box at different times, including the steps of:

continuously imparting to a plurality of empty boxes forces to move said boxes along a line parallel to the line of filling stations;

temporarily stopping an empty box at a ready position opposite each filling station;

sensing a filled box condition at said filling station;

moving one of said empty boxes from its ready position into its opposed filling station in response to said sensing of a filled box condition at said filling station;

releasing a temporarily stopped empty box at the ready position for the preceding filling station;

and controlling and guiding movement of said box from said preceding ready position along said parallel line to the vacated ready position downstream thereof.

* * * * *

UNITED STATES PATENT OFFICE

CERTIFICATE OF CORRECTION

Patent No. 4,010,594 Dated March 8, 1977

Inventor(s) Jerry Lyndell Boyd

It is certified that error appears in the above-identified patent and that said Letters Patent are hereby corrected as shown below:

Column 14, line 43, change "at" to - - to - -; line 51 change "peceeding" to - - preceeding - -; line 52 change "bein" to - - being - -; line 60 change "positons" to - - positions - -. Column 15, line 8, change "wit" to - - with - -. Column 16, line 1, change "temporarly" to - - temporarily - -.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*